US009211697B2

(12) United States Patent
Dooley et al.

(10) Patent No.: US 9,211,697 B2
(45) Date of Patent: Dec. 15, 2015

(54) TRANSFIX SURFACE MEMBER COATING

(71) Applicant: XEROX CORPORATION, Norwalk, CT (US)

(72) Inventors: Brynn Dooley, Toronto (CA); Gabriel Iftime, Cupertino, CA (US); Gordon Sisler, St. Catharines (CA); Barkev Keoshkerian, Thornhill (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/219,481

(22) Filed: Mar. 19, 2014

(65) Prior Publication Data

US 2015/0266290 A1 Sep. 24, 2015

(51) Int. Cl.

| | |
|---|---|
| ***B41J 2/01*** | (2006.01) |
| ***B41J 2/005*** | (2006.01) |
| *B41J 2/385* | (2006.01) |
| *G03G 9/08* | (2006.01) |

(52) U.S. Cl.

CPC ..... *B41J 2/0057* (2013.01); *B41J 2002/012* (2013.01)

(58) Field of Classification Search

CPC ..... B41J 2/01; B41J 2/0057; B41J 2002/012; G03G 2215/1623

USPC ..... 347/101, 103, 154

See application file for complete search history.

(56) References Cited

U.S. PATENT DOCUMENTS

| | | | | | |
|---|---|---|---|---|---|
| 4,970,098 | A * | 11/1990 | Ayala-Esquilin | C08K 3/0008 | 428/36.4 |
| 5,464,703 | A * | 11/1995 | Ferrar | B32B 25/14 | 219/216 |
| 5,474,852 | A * | 12/1995 | Fitzgerald | G03G 15/2057 | 428/35.8 |
| 5,547,759 | A * | 8/1996 | Chen | B32B 25/14 | 219/244 |
| 6,586,100 | B1 * | 7/2003 | Pickering | B32B 25/14 | 399/333 |

OTHER PUBLICATIONS

Brynn Dooley, "Polydiphenylsiloxane Coating Formulation and Method for Forming a Coating", U.S. Patent Application No. (to be assigned), filed Mar. 19, 2014.

Brynn Dooley et al., "Aqueous Ink Jet Blanket", U.S. Appl. No. 14/203,667, filed Mar. 11, 2014.

* cited by examiner

*Primary Examiner* — Jannelle M Lebron
*Assistant Examiner* — Jeremy Bishop
(74) *Attorney, Agent, or Firm* — MH2 Technology Law Group LLP

(57) ABSTRACT

A transfix surface member for use in aqueous ink jet printer comprises a substrate. A conformance layer is disposed on the substrate layer. A surface layer comprising a siloxane polymer network is on the conformance layer. The siloxane polymer network comprises a plurality of diphenylsiloxane moieties and a plurality of polar moieties, the diphenylsiloxane moieties and polar moieties being bonded to the siloxane polymer network by one or more siloxane linkages. An indirect printing apparatus employing the transfix surface member is also disclosed.

20 Claims, 5 Drawing Sheets

TRANSFIX SURFACE MEMBER COATING

FIELD OF THE DISCLOSURE

The present teachings relate to printers and, more particularly, to a transfix surface member for use in a printer.

BACKGROUND

In indirect aqueous printing, an aqueous ink is jetted onto an intermediate imaging surface, referred to herein as a transfix surface member. The ink is partially dried on the transfix surface member prior to transfixing the image to a print medium, such as a sheet of paper.

It is desirable for the transfix surface member to provide both wet image quality, including desired spreading and coalescing of the wet ink; and the image transfer of the dried ink. Wet image quality is best achieved when the transfix surface member has a high surface energy that causes the aqueous ink to spread and wet the surface. The second challenge—image transfer—is best achieved when the transfix surface member has a low surface energy so that the ink, once partially dried, has minimal attraction to the surface and can be more easily transferred to the print medium.

A sacrificial wet layer is sometimes applied to the transfix surface member to aid in providing the desired wet image quality and image transfer. In cases where a sacrificial wet layer is employed, transfix surface members having both sufficiently high surface energy for good wettability and spreading of the sacrificial layer on the transfix member surface, and sufficiently low surface energy to provide release of the sacrificial layer, are desired. In addition, the transfix member can be exposed to relatively high temperatures during printing, so that a thermally stable surface material for the transfix member is also desirable.

Surface coatings exhibiting moderate wettability (not as difficult to wet as silicone or fluorinated materials, yet still exhibit the desired non-stick or anti-contaminant properties) could provide the desired surface energy for transfix surface members. Coatings with moderate wettability could enable spreading of an ink or stabilization of a sacrificial wet layer. However, materials which exhibit both high thermal stability and moderate wettability are virtually non-existent.

SUMMARY

An embodiment of the present disclosure is directed to a transfix surface member for use in aqueous ink jet printer. The transfix surface member comprises a substrate. A conformance layer is disposed on the substrate layer. A surface layer comprising a siloxane polymer network is on the conformance layer. The siloxane polymer network comprises a plurality of diphenylsiloxane moieties and a plurality of polar moieties, the diphenylsiloxane moieties and polar moieties being bonded to the siloxane polymer network by one or more siloxane linkages.

Another embodiment of the present disclosure is directed to an indirect printing apparatus. The indirect printing apparatus comprises a transfix surface member. The transfix surface member comprises a substrate; a conformance layer disposed on the substrate layer; and a surface layer comprising a siloxane polymer network on the conformance layer. The siloxane polymer network comprises a plurality of diphenylsiloxane moieties and a plurality of polar moieties, the diphenylsiloxane moieties and polar moieties being bonded to the siloxane polymer network by one or more siloxane linkages. The indirect printing apparatus further comprises a coating mechanism for forming a sacrificial coating onto the transfer member and a drying station for drying the sacrificial coating. At least one ink jet nozzle is positioned proximate the transfix surface member and configured for jetting ink droplets onto the sacrificial coating formed on the transfix surface member. An ink processing station is configured to at least partially dry the ink on the sacrificial coating formed on the transfix surface member. The indirect printing apparatus further includes a print medium supply and handling system for moving a substrate into contact with the transfix surface member.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present teachings.

Figure 1:
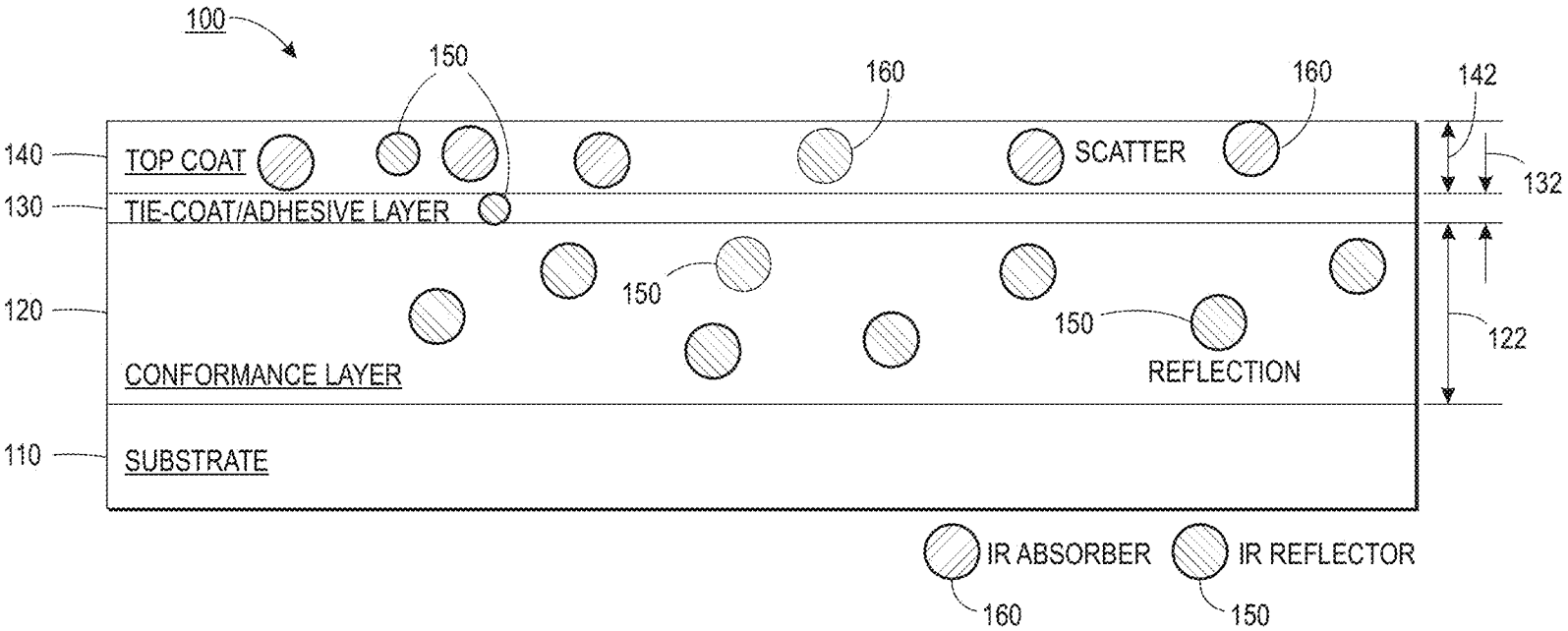
FIG. 1 depicts a schematic cross-sectional view of an illustrative transfix surface member for a printer, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawings that form a part thereof, and in which is shown by way of illustration specific exemplary embodiments in which the present teachings may be practiced. The following description is, therefore, merely exemplary.

Transfix Surface Member

FIG. 1 depicts a schematic cross-sectional view of an illustrative transfix surface member 100 for a printer, according to an embodiment of the present disclosure. The transfix surface member 100 is in the form of a blanket, but can have various other forms as will be described in greater detail below.

The transfix surface member 100 may include a substrate 110. The substrate 110 can be made of any suitable materials. Examples include polymers, such as polyimide, silicone or biaxially-oriented polyethylene terephthalate (e.g., MYLAR), metals such as aluminum or aluminum alloys, woven fabric, quartz or combinations thereof.

A conformance layer 120 may be disposed on the substrate 110. The conformance layer 120 may have a depth or thickness 122 ranging from about 500 μm to about 7000 μm, about 1000 μm to about 5000 μm, or about 2000 μm to about 4000 μm. The conformance layer 120 may comprise a polymer. Examples of suitable polymers include silicone, a cross-linked silane, or a combination thereof.

The conformance layer 120 may also include one or more filler materials (not shown) such as silica, alumina, iron oxide, carbon black, or a combination thereof. The filler materials may be present in the conformance layer 120 in an amount ranging from about 0.1 wt % to about 20 wt %, about 1 wt % to about 15 wt %, or about 2 wt % to about 10 wt %.

The conformance layer 120 may further include one or more infrared ("IR") reflective pigments 150. Examples of reflective pigments 150 include titanium dioxide, nickel rutile, chromium rutile, cobalt-based spinel, chromium oxide, chrome iron nickel black spinel, or a combination thereof. These and other such reflective pigments are generally well known. The reflective pigments 150 may be present in the conformance layer 120 in an amount ranging from about 0.1 wt % to about 20 wt %, about 1 wt % to about 15 wt %, or about 2 wt % to about 10 wt %, based on the total weight of the conformance layer. The reflective pigments 150 may be particles having an average cross-sectional length (e.g., diameter) ranging from about 0.1 μm to about 10 μm, about 0.5 μm to about 8 μm, or about 1 μm to about 5 μm.

An adhesive layer 130 may be disposed on the conformance layer 120. The adhesive layer 130 may have a depth or thickness 132 ranging from about 0.05 μm to about 10 μm, about 0.25 μm to about 5 μm, or about 0.5 μm to about 2 μm. The adhesive layer 130 may be made from a silane, an epoxy silane, an amino silane adhesive, or a combination thereof. In another embodiment, the adhesive layer 130 may be made from a composite material. More particularly, the adhesive layer 130 may be made from or include a polymer matrix. The polymer matrix may be or include silicone, a cross-linked silane, or a combination thereof.

The adhesive layer 130 may further include one or more infrared reflective pigments 150. Thus, the conformance layer 120, the adhesive layer 130, or both may include the reflective pigments 150. The reflective pigments 150 in the adhesive layer 130 may be the same as the reflective pigments 150 in the conformance layer 120, or they may be different. For example, the reflective pigments 150 in the adhesive layer 130 may be or include titanium dioxide, nickel rutile, chromium rutile, cobalt-based spinel, chromium oxide, chrome iron nickel black spinel, or a combination thereof. The reflective pigments 150 may be present in the adhesive layer 130 in an amount ranging from about 0.1 wt % to about 20 wt %, about 1 wt % to about 15 wt %, or about 2 wt % to about 10 wt %, based on the total weight of the adhesive layer.

The reflective pigments 150 in the conformance layer 120 and/or the adhesive layer 130 may reflect radiant energy that has passed through the topcoat layer 140 (discussed below) without being absorbed (i.e., "waste" radiant energy"). The inclusion of the reflective pigments 150 in the conformance layer 120 and/or the adhesive layer 130 may also allow the radiant energy source used during the drying process (e.g., Adphos lamps) to run at reduced power because the efficiency of photothermal conversion may be improved.

A topcoat layer, or surface layer 140, may be disposed on the adhesive layer 130. The surface layer 140 comprises a siloxane polymer network including a plurality of diphenylsiloxane moieties and a plurality of polar moieties. The diphenylsiloxane moieties and polar moieties are covalently bonded to the siloxane polymer network by one or more siloxane linkages. The siloxane polymer network can optionally include non-polar moieties in addition to the polar moieties.

In an embodiment, the diphenylsiloxane moieties are polymer units derived from dialkylsiloxane-diphenylsiloxane copolymers in the coating composition. In an embodiment, the dialkylsiloxane-diphenylsiloxane copolymer has a formula:

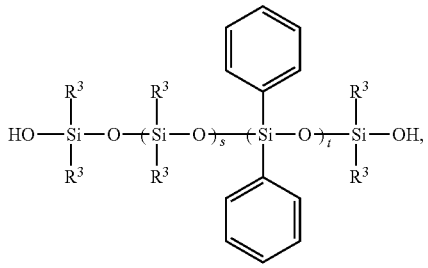

where $R^3$ is a linear, branched or cyclic, saturated or unsaturated alkyl group containing from about 1 to 30 carbon atoms; s is an integer of from 1 to 500; and t is an integer of from 1 to 300. In an embodiment, the diphenylsiloxane moiety is in an amount ranging from about 10% to about 70% by weight relative to the total weight of the polymer network, such as about 20% to about 50%, or about 30% to about 40% by weight relative to the total weight of the polymer network.

The plurality of polar moieties are polymer units derived from one or more polar compounds of formulae I or II:

(I)

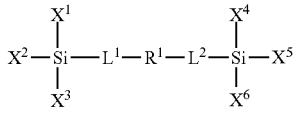

(II)

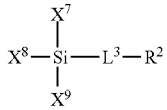

Where $L^1$, $L^2$ and $L^3$ are linker groups, such as, for example $C_1$ to $C_6$ alkyl bridge groups; $X^1$, $X^2$, $X^3$, $X^4$, $X^5$, $X^6$, $X^7$, $X^8$ and $X^9$ are independently selected from the group consisting of a hydroxyl, a reactive alkoxide functionality and an unreactive aliphatic functionality; and $R^1$ and $R^2$ are independently selected from the group consisting of: a) a substituted or unsubstituted polyether group optionally comprising one or more amide moieties, carbonyl moieties, carboxylic acid ester moieties or amine moieties and b) a polyamine group optionally comprising a saturated hydrocarbon chain moiety.

Examples of suitable $R^1$ moieties include the following:

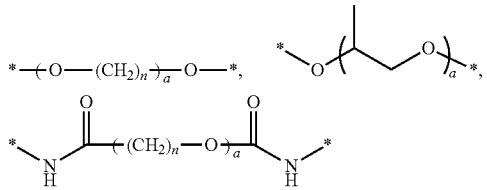

where a is an integer ranging from 0 to about 30; and n is an integer ranging from 0 to 50.

Examples of suitable $R^2$ moieties include the following:

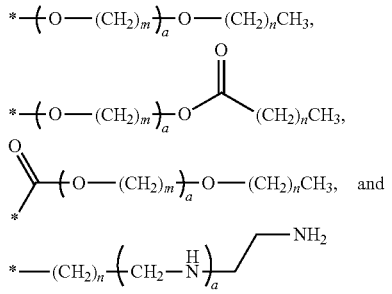

where a is an integer ranging from 0 to about 30; and m and n are integers ranging from 0 to 50.

The polar groups of the present disclosure are generally considered to be hydrophilic. The degree or extent of wetting and release of the topcoat is controlled by the amounts of the hydrophobic and hydrophilic precursors incorporated into the formulation. When more hydrophilic, polar functional groups are incorporated into the coating the surface free energy of the polydiphenylsiloxane-based material increases. Yet these coatings can still remain resistant to contamination (for example by aqueous latex-based pigmented inks) while providing suitable surface free energy for wettability purposes.

Any concentration of polar moieties can be employed in the polymer network to provide the desired surface energy. In an embodiment, the polar moieties can be included in the polymer network in an amount ranging from about 5% to about 90% by weight relative to the total weight of the polymer network, such as about 10% to about 70%, or about 20% to about 50% by weight relative to the total weight of the polymer network. Multiple types of polar moieties can be employed. For example, the siloxane polymer network composition can comprise at least one polar moiety formed from a compound of formula I and at least one polar moiety formed from a compound of formula II.

Figure 2:
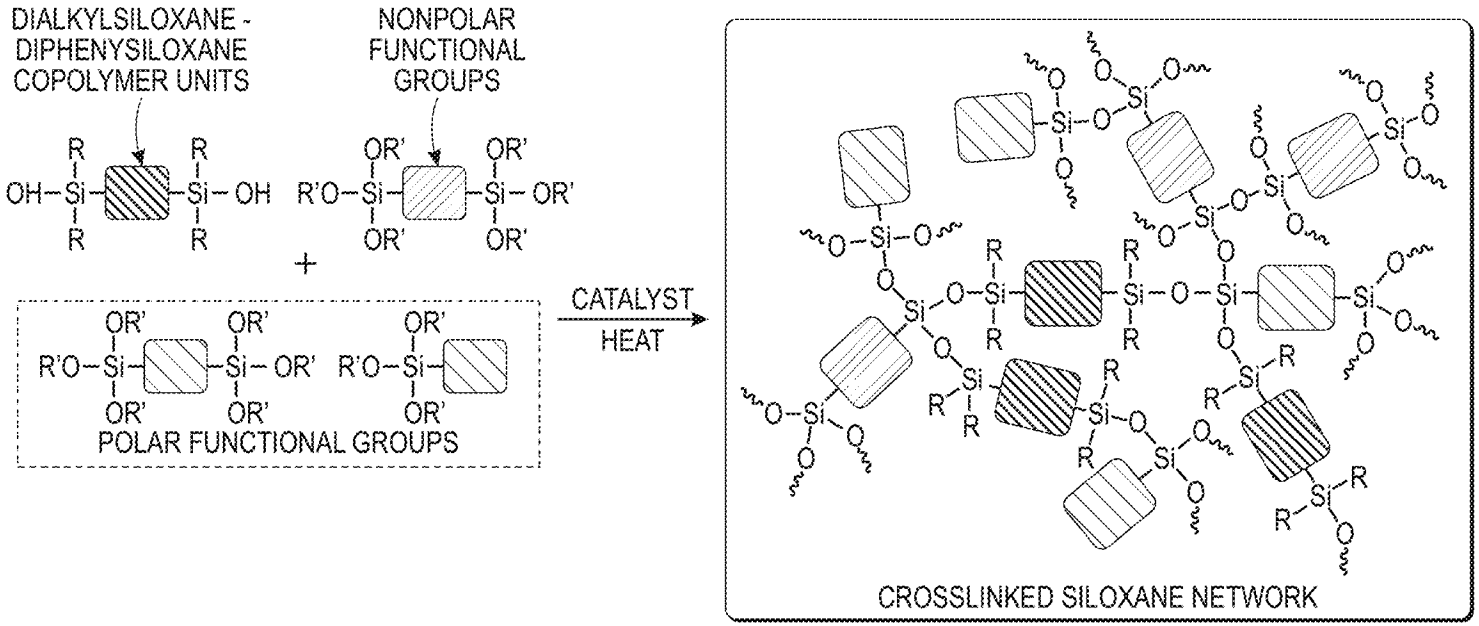
FIG. 2 illustrates an example of a reaction for forming a siloxane polymer network that includes both polar and non-polar moieties, according to an embodiment of the present disclosure.

The siloxane polymer network can also include a plurality of non-polar moieties formed by combining one or more non-polar compounds with the coating composition. An example of a siloxane polymer network that includes both polar and non-polar moieties is shown in FIG. 2.

The non-polar compounds include one or more siloxane compounds of formulae I or II, where $L^1$, $L^2$, $L^3$, $X^1$, $X^2$, $X^3$, $X^4$, $X^5$, $X^6$, $X^7$, $X^8$ and $X^9$ are defined as above for the polar groups; and where $R^1$ and $R^2$ are independently selected from the group consisting of: a) a linear, branched or cyclic, saturated or unsaturated alkyl group, b) a perfluorinated linear, branched or cyclic carbon chain and c) a group having one or more dialkylsiloxane units. For example, $R^1$ can be selected from the group consisting of:

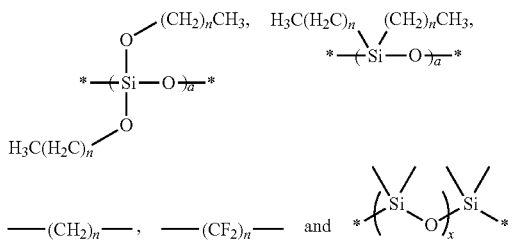

where a and x are integers ranging from 0 to 30; and n is an integer ranging from 0 to 50. Examples of $R^2$ moieties include those selected from the group consisting of:

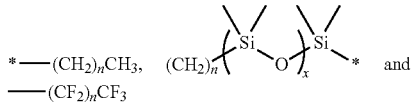

where x is an integer ranging from 0 to 30 and n is an integer ranging from 0 to 50.

The polymer network can be made up of at least 10% silicon by weight. For example, the polymer network can include about 20% to about 70% by weight silicon, such as about 30% to about 60% by weight silicon, relative to the weight of all atomic components in the cured layer.

The topcoat layer 140 can have any desired thickness. As an example, the topcoat layer 140 may have a depth or thickness 142 ranging from about 5 μm to about 100 μm, about 10 μm to about 75 μm, or about 25 μm to about 50 μm.

The topcoat layer 140 may also include one or more infrared absorptive filler materials 160 such as carbon black, graphene, carbon nanotubes, iron oxide, or a combination thereof. The infrared absorptive filler materials may be present in the topcoat layer 140 in an amount ranging from about 0.1 wt % to about 20 wt %, about 1 wt % to about 15 wt %, or about 2 wt % to about 10 wt %, relative to the total weight of the topcoat layer.

The topcoat layer 140 may further include one or more infrared reflective pigments 150. Thus, the conformance layer 120, the adhesive layer 130, the topcoat layer 140, or a combination thereof may include the reflective pigments 150. The reflective pigments 150 in the topcoat layer 130 may be the same as the reflective pigments 150 in the conformance layer 120 and/or the adhesive layer 130, or they may be different. For example, the reflective pigments 150 in the topcoat layer 140 may be or include titanium dioxide, nickel rutile, chromium rutile, cobalt-based spinel, chromium oxide, chrome iron nickel black spinel, or a combination thereof. The reflective pigments 150 may be present in the topcoat layer 140 in an amount ranging from about 0.1 wt % to about 20 wt %, about 1 wt % to about 15 wt %, or about 2 wt % to about 10 wt %.

The incorporation of the reflective pigments 150 into the topcoat layer 140 may improve the reflection of radiant energy back into the ink for absorption by the ink components for improved and/or enhanced ink drying. When the reflective pigments 150 are combined in the topcoat layer 140 with the absorptive materials 160, such as carbon black, the efficiency of photothermal conversion may be enhanced relative to carbon black alone. Further, the differential rate of drying among different ink colors may be reduced or eliminated. The amount of radiant energy waste may be reduced, and the efficiency of the ink drying may improve.

The topcoat layer 140 of the present disclosure can be made by any suitable polymerization process. In an embodiment, the silanol terminated dialkoxysiloxane-diphenylsiloxane monomers, polar monomers and optional non-polar monomers may be combined and cross-linked via condensation chemistry under neutral pH. Hydrolysis and condensation of alkoxide or hydroxide groups can occur, and upon curing at elevated temperatures produces a cross-linked polydiphenylsiloxane coating with polar and optional non-polar moieties that may be used as a surface layer for a transfix surface member in an aqueous ink jet transfix machine. The cross-linked polydiphenylsiloxane-based coating prepared according to the instant disclosure can withstand high temperature conditions without melting or degradation, is mechanically robust under such conditions and/or provides good wettability.

A titanium catalyst can be employed to promote reaction and cross-linking of the monomers to form the polymer network of topcoat layer 140. This can result in the transfix surface member comprising titanium in an amount ranging from about 0.01% to about 5% by weight relative to the total weight of the polymer network. The catalyst can be selected from the group consisting of titanate catalysts, zirconate catalysts and tin catalysts, for example titanium(IV) ethoxide (tetraethyl orthotitanate), titanium(IV) isopropoxide (tetraisopropyl orthotitanate), titanium(IV) butoxide (TYZOR® TBT), titanium diisopropoxide bis(acetylacetanoate) (TYZOR® AA), titanium(IV) (triethanolaminato) isopropoxide (TYZOR® TE), titanium(IV) 2-ethylhexoxide (TYZOR® TOT), titanium di-n-butoxide(bis-2,4-pentanedionate), titanium diisopropoxide(bis-2,4-pentanedionate), titanium trimethylsiloxide, zirconium(IV)bis(diethylcitrato) dipropoxide (TYZOR® ZEC), bis(2-ethylhexanoate)tin, bis (neodecanoate)tin, tin(II) oleate, di-n-butyldilauryltin and di-n-butyldiacetoxytin. The catalyst employed may be one or a combination of a titanate, zirconate, or tin catalyst.

Solvents used for processing of precursors and coating of layers include organic hydrocarbon solvents; alcohols, such as methanol, ethanol, isopropanol and n-butanol; and fluorinated solvents. Further examples of solvents include ketones such as methyl ethyl ketone, methyl isobutyl ketone, and cyclohexanone. Mixtures of solvents may be used. In embodiments, the solvent may be an alcohol solvent. In embodiments, the alcohol solvent may be present in an amount of at least 1 weight percent of the formulation composition, such as from about 1 weight percent to about 60 weight percent, such as from about 3 weight percent to about 40 weight percent, or from about 5 weight percent to about 20 weight percent of the formulation composition.

The liquid coating compositions formed can include any suitable amount of coating precursors and solvent. In an embodiment, solids loading of the composition can range from about 20 weight percent to about 80 weight percent, such as from about 30 weight percent to about 70 weight percent, or from about 40 weight percent to about 60 weight percent.

In embodiments, the liquid coating formulation may be applied to a substrate. In embodiments, the coating solution may be deposited on a substrate using any suitable liquid deposition technique. Exemplary methods for depositing the coating solution on the substrate include draw-down coating, spray coating, spin coating, flow coating, dipping, spraying such as by multiple spray applications of very fine thin films, casting, web-coating, roll-coating, extrusion molding, laminating, or the like. The thickness of the coating solution may be from about 100 nm to about 200 μm, such as from about 500 nm to about 100 μm, or from about 1 μm to about 50 μm.

Following coating of the liquid formulation onto a substrate, a cured film may be formed upon standing or from drying with heat treatment, forming a fully networked polydiphenylsiloxane coating on the substrate. The curing processes according to the instant disclosure may be carried out at any suitable temperature, such as from about 25° C. to about 200° C., or from about 40° C. to about 150° C., or from about 65° C. to about 100° C. The curing process can occur for any suitable length of time.

The monomers are networked together so that all or substantially all polar and optional non-polar monomers are bonded together with the diphenylsiloxane moieties in the cured coating via silicon oxide (Si—O—Si) linkages. Therefore, a molecular weight is not given for the polydiphenylsiloxane-based networked polymer because the coating is cross-linked into one system.

Figure 3:
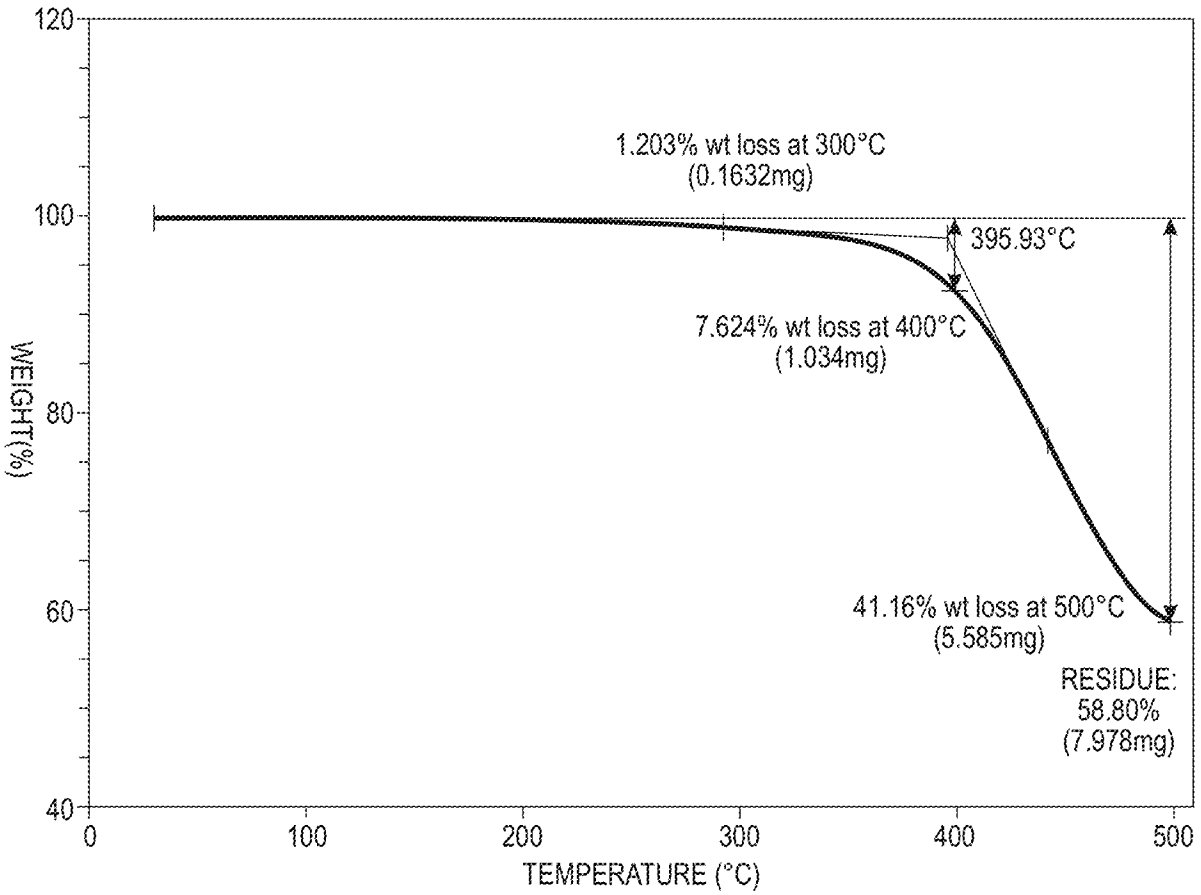
FIG. 3 shows a graph of thermal stability data, as discussed in the examples of the present disclosure.

In embodiments, the networked polydiphenylsiloxane composition does not dissolve when exposed to solvents (such as ketones, chlorinated solvents, ethers etc.). The polymer network can be thermally stable at temperatures up to 300° C. or more, depending on the system. As shown in FIG. 3, the mass loss of the networked polydiphenylsiloxane at about 300° C. is about 1.2 percent by weight. The thermal stability allows a wider operating window for the ink jet transfix apparatus. Furthermore, the cross-linking density is adjustable based on monomer choice, which enables tuning of their mechanical properties.

In addition to being thermally stable, the networked polydiphenylsiloxane coatings can have moderate surface free energy, which can be tuned based on the type and amount of polar and non-polar moieties. Example ranges of potential surface free energies for the coatings include ranges of about 20 mN/m to about 40 mN/m, or about 23 mN/m to about 37 mN/m, or about 25 mN/m to about 35 mN/m.

Printer Employing Transfix Member

Figure 4:
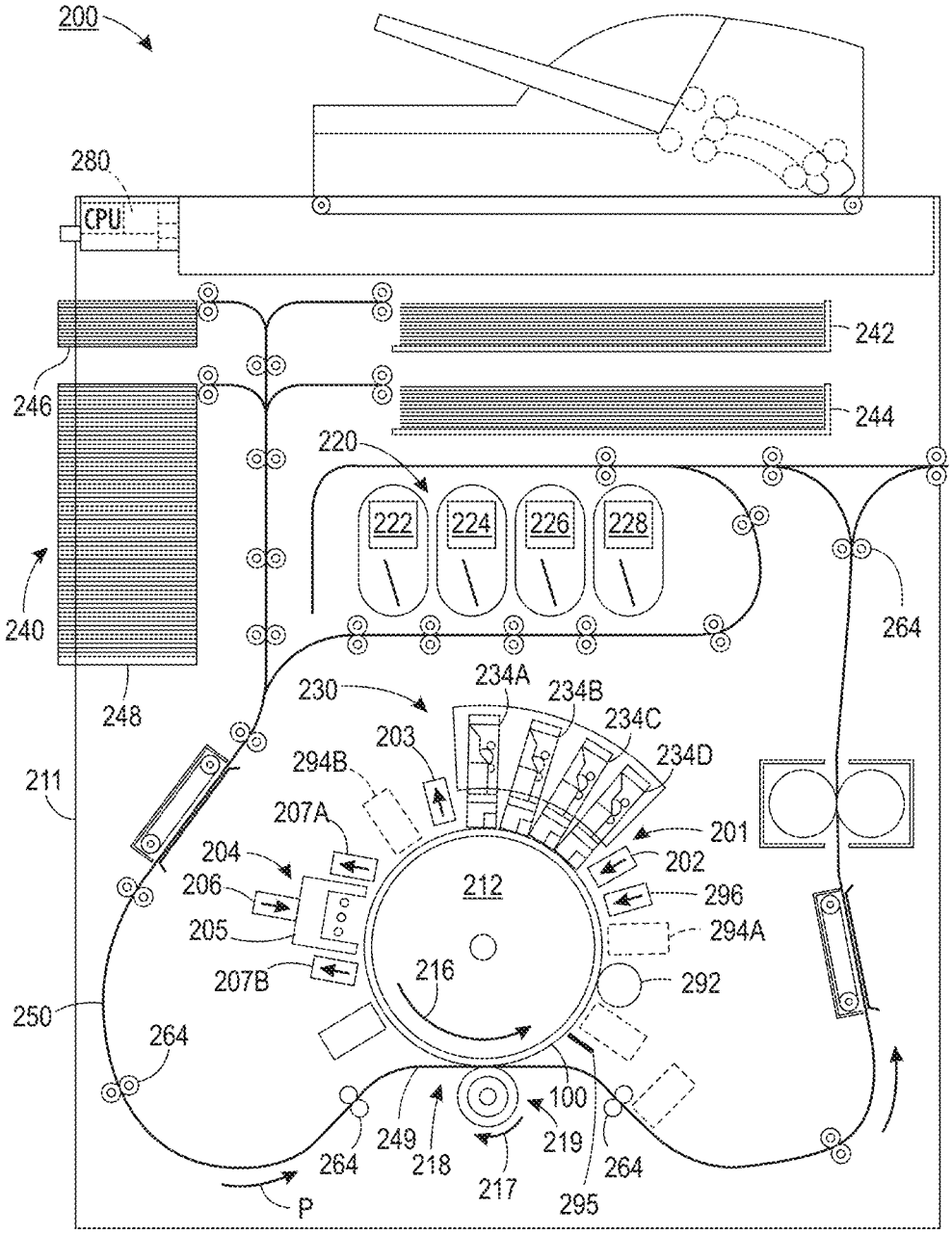
FIG. 4 depicts a printer including a transfix surface member, according to an embodiment of the present disclosure.

FIG. 4 depicts a printer 200 including the transfix surface member 100, according to an embodiment of the present disclosure. The printer 200 may be an indirect aqueous inkjet printer that forms an ink image on a surface of the transfix surface member 100. Examples of aqueous inkjet printers are described in more detail in U.S. patent application Ser. No. 14/032,945, filed Sep. 20, 2013, and U.S. patent application Ser. No. 14/105,498, filed Dec. 13, 2013, the disclosures of both of which are herein incorporated by reference in their entireties.

The printer 200 includes a frame 211 that supports operating subsystems and components, which are described below. The printer 200 includes an intermediate transfer member, which is illustrated as comprising a rotating imaging drum 212 and a transfix surface member 100. In an embodiment, the transfix surface member 100 is in the form of a blanket that is manufactured separately and then mounted about the circumference of the drum 212. In another embodiment, the transfix surface member 100 is coated directly onto the intermediate transfer member so as to form an integral outer surface thereof. In this coated drum embodiment, the substrate 110 of the transfer member may be a surface of the drum 212. In yet other embodiments, the intermediate transfer member may be in the form of an endless belt comprising the transfix surface member coated thereon. Suitable endless belt mechanisms are well known in the art.

The transfix surface member 100 may move in a direction 216 as the drum 212 rotates. The transfix roller 219 may rotate in the direction 217 and be loaded against the surface of transfix surface member 100 to form the transfix nip 218, within which ink images formed on the surface of transfix surface member 100 are transfixed onto a print medium 249. In some embodiments, a heater (not shown) in the drum 212 or in another location of the printer heats the transfix surface member 100 to a temperature in a range of, for example, approximately 50° C. to approximately 70° C. The elevated temperature promotes partial drying of the liquid carrier that is used to deposit the hydrophilic composition and the water in the aqueous ink drops that are deposited on the transfix surface member 100.

A surface maintenance unit ("SMU") 292 may remove residual ink left on the surface of the transfix surface member 100 after the ink images are transferred to the print medium 249. The SMU 292 may include a coating applicator, such as a donor roller (not shown), which is partially submerged in a reservoir (not shown) that holds a hydrophilic sacrificial coating composition in a liquid carrier. The donor roller may draw the liquid sacrificial coating composition from the reservoir and deposit a layer of the sacrificial composition on the transfix surface member 100. After a drying process, which can be carried out, for example, by a dryer 296, the dried sacrificial coating may substantially cover a surface of the transfix surface member 100 before the printer 200 ejects ink drops during a print process.

The printer 200 may also include an aqueous ink supply and delivery subsystem 220 that has at least one source 222 of one color of aqueous ink. In an embodiment, the printer 200 is a multicolor image producing machine, the ink delivery system 220 including, for example, four (4) sources 222, 224, 226, 228, representing four (4) different colors CYMK (cyan, yellow, magenta, black) of aqueous inks.

A printhead system 230 may include a printhead support 232, which provides support for a plurality of printhead modules, also known as print box units, 234A-234D. Each printhead module 234A-234D effectively extends across a width of the transfix surface member 100 and ejects ink drops onto the transfix surface member 100. A printhead module 234A-234D may include a single printhead or a plurality of printheads configured in a staggered arrangement. The printhead modules 234A-234D may include associated electronics, ink reservoirs, and ink conduits to supply ink to the one or more printheads, as would be understood by one of ordinary skill in the art.

After the printed image on the transfix surface member 100 exits the print zone, the image passes under an image dryer 204. The image dryer 204 may include a heater 205, such as a radiant infrared heater, a radiant near infrared heater, and/or a forced hot air convection heater. The image dryer 204 may also include a dryer 206, which is illustrated as a heated air source, and air returns 207A and 207B. The heater 205 may apply, for example, infrared heat to the printed image on the surface of the transfix surface member 100 to evaporate water or solvent in the ink. The heated air source 206 may direct heated air over the ink to supplement the evaporation of the water or solvent from the ink. In an embodiment, the dryer 206 may be a heated air source with the same design as the dryer 296. While the dryer 296 may be positioned along the process direction to dry the hydrophilic sacrificial coating, the dryer 206 may also be positioned along the process direction after the printhead modules 234A-234D to at least partially dry the aqueous ink on the transfix surface member 100. The air may then be collected and evacuated by air returns 207A and 207B to reduce the interference of the air flow with other components in the printing area.

The printer 200 may further include a print medium supply and handling system 240 that stores, for example, one or more stacks of paper print mediums of various sizes, as well as various other components useful for handling and transferring the print medium. While example handling and transfer components are illustrated at 242, 244, 246, 250 and 264, any suitable supply and handling system can be employed, as would be readily understood by one of ordinary skill in the art.

Operation and control of the various subsystems, components, and functions of the printer 200 may be performed with the aid of the controller 280. In an embodiment, the controller 280 may be the main multi-tasking processor for operating and controlling all of the other machine subsystems and functions.

Once an image or images have been formed on the transfix surface member 100 and sacrificial coating, components within the printer 200 may operate to perform a process for transferring and fixing the image or images from the transfix surface member 100 to media. For example, heat and/or pressure can be applied by the transfix roller 219 to the back side of the heated print medium 249 to facilitate the transfixing (transfer and fusing) of the image from the intermediate transfer member onto the print medium 249. In an embodiment, the sacrificial coating is also transferred from the intermediate transfer member to the print medium 249 as part of the transfixing process.

After the intermediate transfer member moves through the transfix nip 218, the image receiving surface passes a cleaning unit that can remove any residual portions of the sacrificial coating and small amounts of residual ink from the image receiving surface of the transfix surface member 100.

As used herein, unless otherwise specified, the word "printer" encompasses any apparatus that performs a print outputting function for any purpose, such as a digital copier, bookmaking machine, facsimile machine, a multi-function machine, electrostatographic device, etc.

Specific examples will now be described in detail. These examples are intended to be illustrative, and not limited to the materials, conditions, or process parameters set forth in these embodiments. All parts are percentages by solid weight unless otherwise indicated.

EXAMPLES

The following DPS-based materials of Examples 1-3 were formulated and coated on a variety of different substrates. In all cases the coatings exhibited strong adhesion to the substrates enabling primer-free application. Following preparation ATR-IR spectra were recorded. Minimal —OH stretching was observed and is consistent with complete or near complete condensation of all silanol functional groups (complete reaction). TGA spectra were collected to evaluate thermal stability (FIG. 3). All coatings were stable to 300° C. Differences in ink wettability were observed by airbrushing atomized ink droplets onto the surface and looking at the droplet behavior by optical microscopy.

Example 1

Siloxane formulation components for Example 1 are set forth in Table 1 below.

TABLE 1

| Chemical structure | Chemical name | Mass (g) | wt % (of total silanes) |
|---|---|---|---|
| 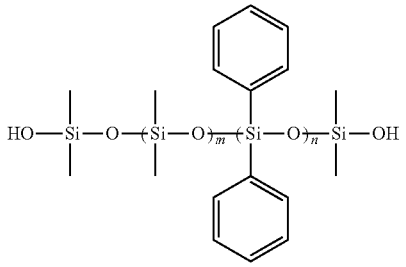 | Silanol terminated dimethylsiloxane-diphenylsiloxane copolymer | 1.52 | 50 |

TABLE 1-continued

| Chemical structure | Chemical name | Mass (g) | wt % (of total silanes) |
|---|---|---|---|
| 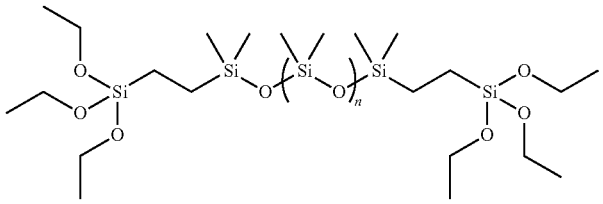 | Triethoxysilylethyl terminated polydimethylsiloxane | 0.57 | 19 |
| 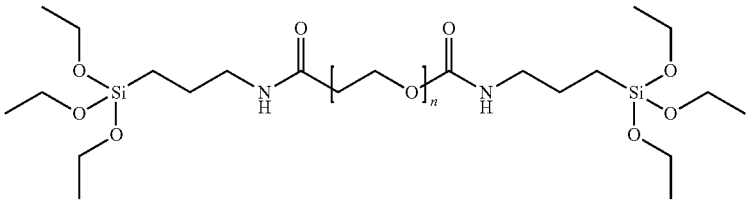 | N,N'-bis-[(3-triethoxysilylpropyl)aminocarbonyl] polyethylene oxide | 0.37 | 12 |
| 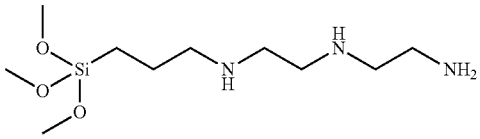 | 3-(trimethoxysilylpropyl) diethylenetriamine | 0.57 | 19 |

Silanol terminated dimethylsiloxane-diphenylsiloxane copolymer (1.52 g), triethoxysilylethyl terminated polydimethylsiloxane (0.57 g), N,N'-bis-[(3-triethoxysilylpropyl) aminocarbonyl]polyethylene oxide (10-15 EO) (0.37 g), and 3-(trimethoxysilylpropyl)diethylenetriamine (0.57 g) were combined in a vial and mixed by vortex for 10 s at 2500 rpm. Cyclohexanone (0.27 g) was added to the vial, followed by titanium acetylacetonate (0.20 g of a 75% active solution in IPA; 5 wt % active catalyst relative to all siloxanes). The solution was mixed by vortex for 10 s at 2500 rpm.

The coating solution was filtered through a 0.45 μm PTFE filter immediately prior to coating to remove any particulates. The coating solution was draw down coated on polyimide or aluminum or silicone or Mylar substrates or cast onto quartz yielding uniform coatings. The coating solution formed a stable wet layer on all substrates tested. The coatings were cured at 90° C. with ~50% relative humidity for 1 h to give clear, uniform films.

Example 2

Siloxane formulation components for Example 2 are set forth in Table 2 below.

TABLE 2

| Chemical structure | Chemical name | Mass (g) | wt % (of total silanes) |
|---|---|---|---|
| 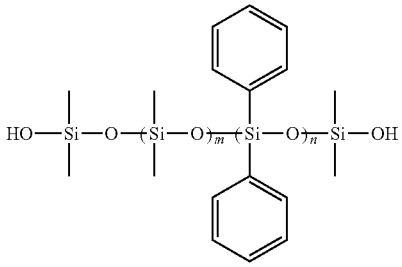 | Silanol terminated dimethylsiloxane-diphenylsiloxane copolymer | 1.12 | 53 |

TABLE 2-continued

| Chemical structure | Chemical name | Mass (g) | wt % (of total silanes) |
|---|---|---|---|
| 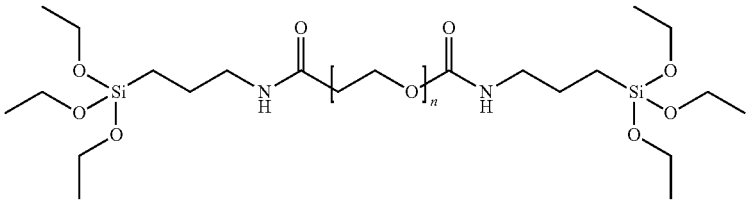 | N,N'-bis-[(3-triethoxysilylpropyl)aminocarbonyl] polyethylene oxide | 0.37 | 18 |
| 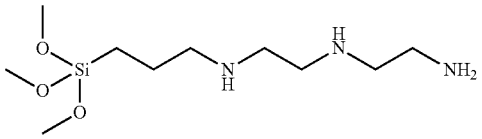 | 3-(trimethoxysilylpropyl) diethylenetriamine | 0.60 | 29 |

Silanol terminated dimethylsiloxane-diphenylsiloxane copolymer (1.12 g), N,N'-bis-[(3-triethoxysilylpropyl)aminocarbonyl]polyethylene oxide (10-15 EO) (0.37 g), and 3-(trimethoxysilylpropyl)diethylenetriamine (0.60 g) were combined in a vial and mixed by vortex for 10 s at 2500 rpm. Cyclohexanone (0.33 g) was added to the vial, followed by titanium acetylacetonate (0.14 g of a 75% active solution in IPA; 5 wt % active catalyst relative to all silanes). The solution was mixed by vortex for 10 s at 2500 rpm.

The coating solution was filtered through a 0.45 μm PTFE filter immediately prior to coating to remove any particulates. The coating solution was draw down coated on polyimide or aluminum or silicone or Mylar substrates or cast onto quartz yielding uniform coatings. The coating solution formed a stable wet layer on all substrates tested. The coatings were cured at 90° C. with ~50% relative humidity for 1 h to give clear, uniform films.

Example 3

Siloxane formulation components for Example 3 are set forth in Table 3 below.

TABLE 3

| Chemical structure | Chemical name | Mass (g) | wt % (of total silanes) |
|---|---|---|---|
| 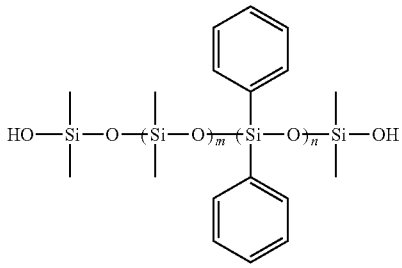 | Silanol terminated dimethylsiloxane-diphenylsiloxane copolymer | 1.51 | 50 |
| 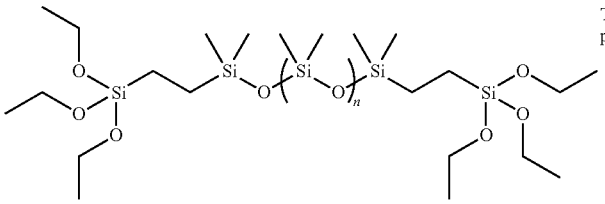 | Triethoxysilylethyl terminated polydimethylsiloxane | 0.57 | 19 |
| 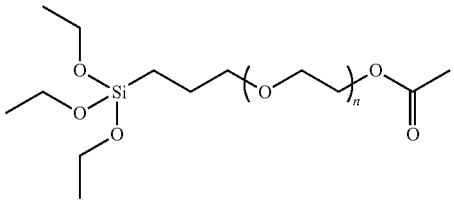 | 2-(acetoxy(polyethyleneoxy)propyl) triethoxysilane | 0.37 | 12 |

TABLE 3-continued

| Chemical structure | Chemical name | Mass (g) | wt % (of total silanes) |
|---|---|---|---|
| 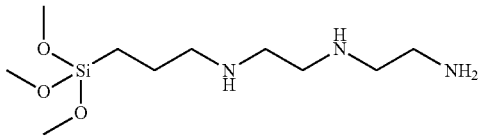 | 3-(trimethoxysilylpropyl) diethylenetriamine | 0.56 | 19 |

Silanol terminated dimethylsiloxane-diphenylsiloxane copolymer (1.51 g), triethoxysilylethyl terminated polydimethylsiloxane (0.57 g), 2-(acetoxy(polyethyleneoxy)propyl) triethoxysilane (0.37 g), and 3-(trimethoxysilylpropyl)diethylenetriamine (0.60 g) were combined in a vial and mixed by vortex for 10 s at 2500 rpm. Cyclohexanone (0.26 g) was added to the vial, followed by titanium acetylacetonate (0.21 g of a 75% active solution in IPA; 5 wt % active catalyst relative to all silanes).

The solution was mixed by vortex for 10 s at 2500 rpm. The coating solution was filtered through a 0.45 μm PTFE filter immediately prior to coating to remove any particulates. The coating solution was draw down coated on polyimide or aluminum or silicone or Mylar substrates or cast onto quartz yielding uniform coatings. The coating solution formed a stable wet layer on all substrates tested. The coatings were cured at 90° C. with ~50% relative humidity for 1 h to give clear, uniform films.

Example 4

Siloxane formulation components for Example 4 are set forth in Table 4 below.

Silanol terminated dimethylsiloxane-diphenylsiloxane copolymer (3.26 g) and triethoxysilylethyl terminated polydimethylsiloxane (3.26 g) were combined in a vial and mixed by vortex for 10 s at 2500 rpm. Cyclohexanone (0.26 g) was added to the vial, followed by titanium acetylacetonate (0.46 g of a 75% active solution in IPA; 5 wt % active catalyst relative to all silanes).

The solution was mixed by vortex for 10 s at 2500 rpm. The coating solution was filtered through a 0.45 μm PTFE filter immediately prior to coating to remove any particulates. The coating solution was draw down coated on polyimide or aluminum or silicone or Mylar substrates or cast onto quartz yielding uniform coatings. The coating solution formed a stable wet layer on all substrates tested. The coatings were cured at 130° C. with ~50% relative humidity for 1 h to give clear, uniform films.

Example 5

Siloxane formulation components for Example 5 are set forth in Table 5 below.

TABLE 4

| Chemical structure | Chemical name | Mass (g) | wt % (of total silanes) |
|---|---|---|---|
| 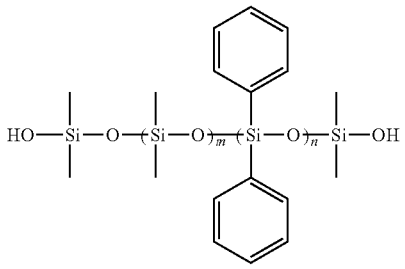 | Silanol terminated dimethylsiloxane-diphenylsiloxane copolymer | 3.26 | 50 |
| 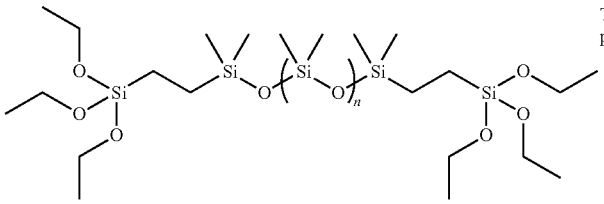 | Triethoxysilylethyl terminated polydimethylsiloxane | 3.26 | 50 |

TABLE 5

| Chemical structure | Chemical name | Mass (g) | wt % (of total silanes) |
|---|---|---|---|
| 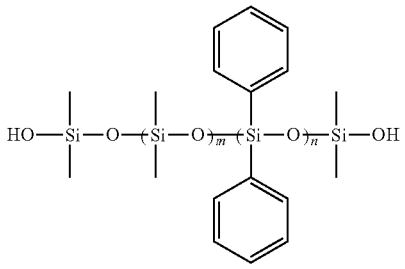 | Silanol terminated dimethylsiloxane-diphenylsiloxane copolymer | 1.50 | 50 |
| 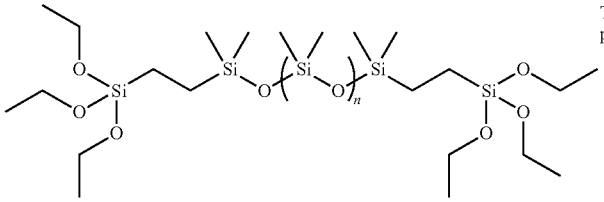 | Triethoxysilylethyl terminated polydimethylsiloxane | 1.13 | 37 |
| 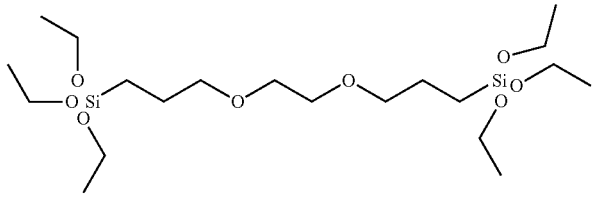 | Bis(3-triethoxysilylpropyl)polyethylene oxide | 0.39 | 13 |

Silanol terminated dimethylsiloxane-diphenylsiloxane copolymer (1.50 g), triethoxysilylethyl terminated polydimethylsiloxane (1.13 g), and a polar group forming monomer, bis(3-triethoxysilylpropyl)polyethylene oxide (0.39 g), were combined in a vial and mixed by vortex for 10 s at 2500 rpm. Cyclohexanone (0.31 g) was added to the vial, followed by titanium acetylacetonate (0.21 g of a 75% active solution in IPA; 5 wt % active catalyst relative to all silanes).

The solution was mixed by vortex for 10 s at 2500 rpm. The coating solution was filtered through a 0.45 μm PTFE filter immediately prior to coating to remove any particulates. The coating solution was draw down coated on polyimide or aluminum or silicone or Mylar substrates or cast onto quartz yielding uniform coatings. The coating solution formed a stable wet layer on all substrates tested. The coatings were cured at 90° C. with ~50% relative humidity for 1 h to give clear, uniform films.

Example 6

Siloxane formulation components for Example 6 are set forth in Table 6 below.

TABLE 6

| Chemical structure | Chemical name | Mass (g) | wt % (of total silanes) |
|---|---|---|---|
| 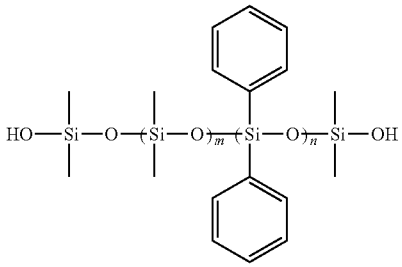 | Silanol terminated dimethylsiloxane-diphenylsiloxane copolymer | 0.80 | 38 |

TABLE 6-continued

| Chemical structure | Chemical name | Mass (g) | wt % (of total silanes) |
|---|---|---|---|
| 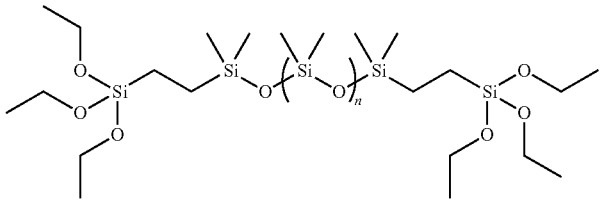 | Triethoxysilylethyl terminated polydimethylsiloxane | 0.30 | 15 |
| 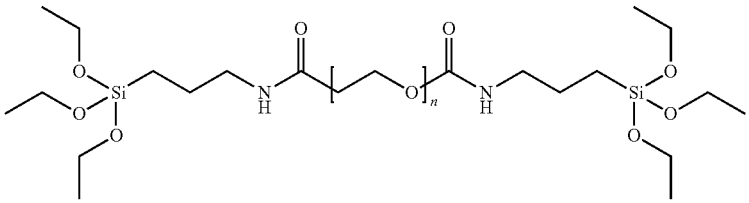 | N,N'-bis-[(3-triethoxysilylpropyl)aminocarbonyl] polyethylene oxide | 0.30 | 15 |
| 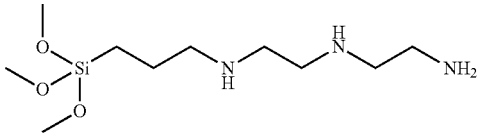 | 3-(trimethoxysilylpropyl) diethylenetriamine | 0.66 | 32 |

Silanol terminated dimethylsiloxane-diphenylsiloxane copolymer (0.80 g), triethoxysilylethyl terminated polydimethylsiloxane (0.30 g), and two polar group forming monomers, N,N'-bis-[(3-triethoxysilylpropyl)aminocarbonyl] polyethylene oxide (0.30 g) and 3-(trimethoxysilylpropyl) diethylenetriamine (0.66 g), were combined in a vial and mixed by vortex for 10 s at 2500 rpm. Cyclohexanone (0.19 g) was added to the vial, followed by titanium acetylacetonate (0.14 g of a 75% active solution in IPA; 5 wt % active catalyst relative to all silanes).

The solution was mixed by vortex for 10 s at 2500 rpm. The coating solution was filtered through a 0.45 μm PTFE filter immediately prior to coating to remove any particulates. The coating solution was draw down coated on polyimide or aluminum or silicone or Mylar substrates or cast onto quartz yielding uniform coatings. The coating solution formed a stable wet layer on all substrates tested. The coatings were cured at 90° C. with ~50% relative humidity for 1 h to give clear, uniform films.

Figure 5:
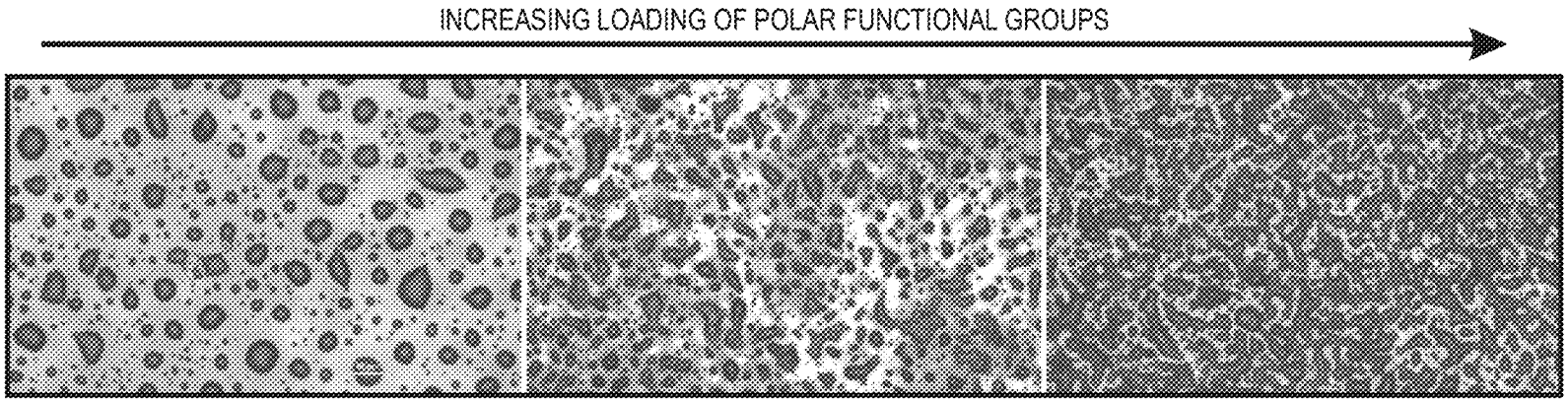
FIG. 5 shows results of optical microscopy of atomized ink droplets airbrushed onto coatings, as discussed in the examples.

FIG. 5 shows optical microscopy of atomized ink droplets airbrushed onto the polydiphenylsiloxane-based coatings of Examples 4, 5 and 6, with Example 4 being least polar (left most image) and Example 6 being the most polar (best ink wetting, right-most image). FIG. 5 shows that the polydiphenylsiloxane coatings of Examples 5 and 6, containing polar functional groups, exhibited improved wetting of the atomized ink droplets compared to the coating of Example 4, made without polar functional groups. These results demonstrate that increased loading of polar functional groups resulted in increased wettability.

The compositions of the present disclosure include a class of tunable diphenylsiloxane-based composite materials containing polar functional groups covalently bound in the network. In addition to their tunable surface properties, these materials exhibit good thermal stability to ~300° C., adjustable cross-linking density (mechanical) and/or good adhesion to a variety of substrates. These combined properties make this class of materials promising candidates for use as topcoat layers in aqueous transfix printing applications.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A transfix surface member for use in an aqueous ink jet printer, comprising:

a substrate;

a conformance layer disposed on the substrate layer; and a surface layer comprising a siloxane polymer network on the conformance layer, the siloxane polymer network comprising a plurality of diphenylsiloxane moieties and a plurality of polar moieties, the diphenylsiloxane moieties and polar moieties being bonded to the siloxane polymer network by one or more siloxane linkages.

2. The transfix surface member of claim 1, wherein the diphenylsiloxane moiety is in an amount ranging from about 10% to about 50% by weight relative to the total weight of the polymer network.

3. The transfix surface member of claim 1, wherein the siloxane polymer network is made by combining one or more polar compounds and a dialkylsiloxane-diphenylsiloxane copolymer to form a coating composition.

4. The transfix surface member of claim 3, wherein the one or more polar compounds are siloxane units of formulae I or II:

(I)

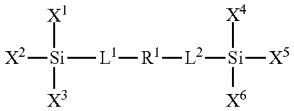

(II)

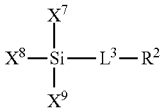

where:

$L^1$, $L^2$ and $L^3$ are linker groups;

$X^1$, $X^2$, $X^3$, $X^4$, $X^5$, $X^6$, $X^7$, $X^8$ and $X^9$ are independently selected from the group consisting of a hydroxyl, a reactive alkoxide functionality and an unreactive aliphatic functionality; and $R^1$ and $R^2$ are independently selected from the group consisting of: a) a substituted or unsubstituted polyether group optionally comprising one or more amide moieties, carbonyl moieties, carboxylic acid ester moieties or amine moieties and b) a polyamine group optionally comprising a saturated hydrocarbon chain moiety.

5. The transfix surface member of claim 4, wherein the siloxane polymer network composition comprises at least one polar moiety formed from a compound of formula I and at least one polar moiety formed from a compound of formula II.

6. The transfix surface member of claim 4, wherein $L^1$, $L^2$ and $L^3$ are independently selected $C_1$ to $C_6$ alkyl bridge groups.

7. The transfix surface member of claim 4, wherein $R^1$ is a moiety selected from the group consisting of:

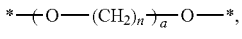

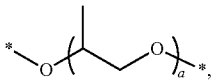

-continued

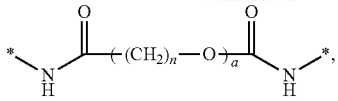

and $R^2$ is a moiety selected from the group consisting of:

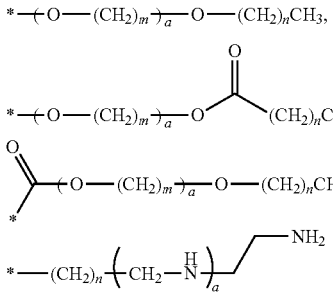

where a is an integer ranging from 0 to about 30; and m and n are integers ranging from 0 to 50.

8. The transfix surface member of claim 3, wherein the siloxane polymer network further comprises a plurality of non-polar moieties formed by combining one or more non-polar compounds with the coating composition.

9. The transfix surface member of claim 8, wherein the non-polar compounds include one or more siloxane compounds of formulae I or II:

(I)

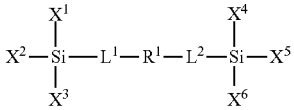

(II)

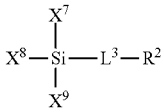

where:

$L^1$, $L^2$ and $L^3$ are linker groups;

$X^1$, $X^2$, $X^3$, $X^4$, $X^5$, $X^6$, $X^7$, $X^8$ and $X^9$ are independently selected from the group consisting of a hydroxyl, a reactive alkoxide functionality and an unreactive aliphatic functionality; and $R^1$ and $R^2$ are independently selected from the group consisting of: a) a linear, branched or cyclic, saturated or unsaturated alkyl group, b) a perfluorinated linear, branched or cyclic carbon chain and c) a group having one or more dialkylsiloxane units.

10. The transfix surface member of claim 9, wherein $L^1$, $L^2$ and $L^3$ are independently selected $C_1$ to $C_6$ alkyl bridge groups.

11. The transfix surface member of claim 9, wherein at least one of $R^1$ and $R^2$ is a moiety having one or more dialkylsiloxane units.

12. The transfix surface member of claim 11, wherein $R^1$ is a moiety of a general formula selected from the group consisting of:

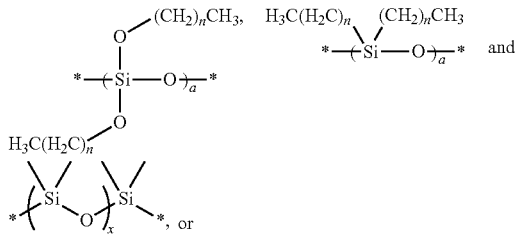

$R^2$ is a moiety of a general formula:

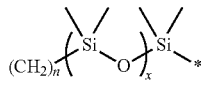

where:

a and x are integers ranging from 0 to 30; and n is an integer ranging from 0 to 50.

13. The transfix surface member of claim 9, wherein $R^1$ is a moiety of a general formula selected from the group consisting of:

$—(CF_2)_n—$ and $—(CH_2)_n—$, or $R^2$ is a moiety of a general formula selected from the group consisting of:

$*—(CH_2)_nCH_3$, and $—(CF_2)_nCF_3$ where n is an integer ranging from 0 to 50.

14. The transfix surface member of claim 3, wherein the dialkylsiloxane-diphenylsiloxane copolymer is

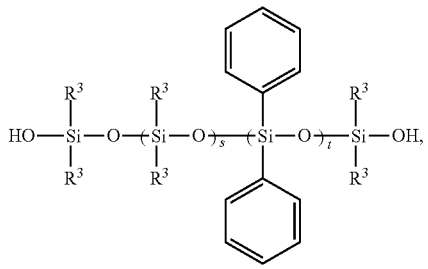

where:

$R^3$ is a linear, branched or cyclic, saturated or unsaturated alkyl group containing from about 1 to 30 carbon atoms;

s is an integer of from 1 to 500; and t is an integer of from 1 to 300.

15. The transfix surface member of claim 1, further comprising titanium in an amount ranging from about 0.01% to about 5% by weight relative to the total weight of the polymer network composition.

16. The transfix surface member of claim 1, wherein the transfix surface member is in the form of a blanket.

17. An aqueous inkjet printer comprising:

a transfix surface member, the transfix surface member comprising:

a substrate;

a conformance layer disposed on the substrate layer; and a surface layer comprising a siloxane polymer network on the conformance layer, the siloxane polymer network comprising a plurality of diphenylsiloxane moieties and a plurality of polar moieties, the diphenylsiloxane moieties and polar moieties being bonded to the siloxane polymer network by one or more siloxane linkages;

a coating mechanism for forming a sacrificial coating onto the transfer member;

a drying station for drying the sacrificial coating;

at least one ink jet nozzle positioned proximate the transfix surface member and configured for jetting ink droplets onto the sacrificial coating formed on the transfix surface member;

an ink processing station configured to at least partially dry the ink on the sacrificial coating formed on the transfix surface member; and a print medium supply and handling system for moving a substrate into contact with the transfix surface member.

18. The aqueous inkjet printer of claim 17, wherein the diphenylsiloxane moieties are in an amount ranging from about 10% to about 50% by weight relative to the total weight of the polymer network.

19. The aqueous inkjet printer of claim 17, wherein the siloxane polymer network is made by combining one or more polar compounds and a dialkylsiloxane-diphenylsiloxane copolymer to form a coating composition.

20. The aqueous inkjet printer of claim 19, wherein the one or more polar compounds are siloxane units of formulae I or II:

(I)

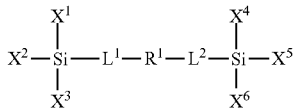

(II)

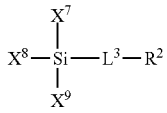

where:

$L^1$, $L^2$ and $L^3$ are linker groups;

$X^1$, $X^2$, $X^3$, $X^4$, $X^5$, $X^6$, $X^7$, $X^8$ and $X^9$ are independently selected from the group consisting of a hydroxyl, a reactive alkoxide functionality and an unreactive aliphatic functionality; and $R^1$ and $R^2$ are independently selected from the group consisting of: a) a substituted or unsubstituted polyether group optionally comprising one or more amide moieties, carbonyl moieties, carboxylic acid ester moieties or amine moieties and b) a polyamine group optionally comprising a saturated hydrocarbon chain moiety.

* * * * *